US009452315B1

(12) United States Patent
Murray et al.

(10) Patent No.: US 9,452,315 B1
(45) Date of Patent: Sep. 27, 2016

(54) TREADMILL

(71) Applicant: Dyaco International Inc., Taipei (TW)

(72) Inventors: Brian Murray, Taipei (TW); Sheng-Chih Hsieh, Taipei (TW); Shang-Wei Yeh, Taipei (TW)

(73) Assignee: Dyaco International, Inc., Taipei (TW)

( * ) Notice: Subject to any disclaimer, the term of this patent is extended or adjusted under 35 U.S.C. 154(b) by 0 days.

(21) Appl. No.: 14/675,280

(22) Filed: Mar. 31, 2015

(30) Foreign Application Priority Data

Mar. 6, 2015 (TW) ..... 104107265 A

(51) Int. Cl.
*A63B 22/02* (2006.01)
*A63B 22/00* (2006.01)
*A63B 71/00* (2006.01)

(52) U.S. Cl.
CPC ..... *A63B 22/02* (2013.01)

(58) Field of Classification Search
CPC .. A63B 22/00; A63B 22/02; A63B 22/0015; A63B 22/0235; A63B 22/0017; A63B 22/0207; A63B 22/0214; A63B 22/0221; A63B 22/0228; A63B 22/0242; A63B 22/0257; A63B 22/0285; A63B 2022/025; A63B 2022/0264; A63B 2022/0271
USPC ..... 482/51, 54
See application file for complete search history.

(56) References Cited

U.S. PATENT DOCUMENTS 4,374,587 A * 2/1983 Ogden ..... A63B 22/0023 482/54
4,576,352 A * 3/1986 Ogden ..... A63B 22/0023 248/188.4
4,602,779 A * 7/1986 Ogden ..... A63B 22/0023 198/846
4,759,540 A * 7/1988 Yu ..... A63B 22/0023 482/54
5,085,426 A * 2/1992 Wanzer ..... A63B 22/02 482/54
5,462,504 A * 10/1995 Trulaske ..... A61B 5/0002 482/54
5,702,325 A * 12/1997 Watterson ..... A63B 22/02 482/51
5,733,228 A * 3/1998 Stevens ..... A63B 22/0023 482/51
5,833,577 A * 11/1998 Hurt ..... A63B 22/02 482/51
5,855,537 A * 1/1999 Coody ..... A63B 22/0023 482/51
6,179,753 B1 * 1/2001 Barker ..... A63B 22/0214 482/51

(Continued)

FOREIGN PATENT DOCUMENTS

TW 529432 U 4/2003
TW M398438 U1 2/2011

(Continued)

OTHER PUBLICATIONS

Office Action Dated May 4, 2016 in corresponding Taiwan Patent Application No. 104107265.

*Primary Examiner* — Loan H Thanh
*Assistant Examiner* — Garrett Atkinson
(74) *Attorney, Agent, or Firm* — Donald E. Stout; Stout, Uxa & Buyan, LLP

(57) ABSTRACT

A treadmill comprises a base, a first frame, a second frame, and a driving assembly. The base allows a user to walk or run in place. The first frame and the second frame pivotally couple with a front portion and a rear portion of the base, respectively. The driving assembly moveably couples with the first frame and the second frame. The moving of the driving assembly between the first frame and the second frame will result in an elevation of the front portion or the rear portion.

6 Claims, 7 Drawing Sheets

(56) References Cited

U.S. PATENT DOCUMENTS 6,592,496 B1 * 7/2003 Tsou ..... A63B 22/0023 482/54
6,695,751 B1 * 2/2004 Hsu ..... A63B 22/02 482/54
6,730,002 B2 * 5/2004 Hald ..... A63B 22/0023 482/51
6,872,169 B2 * 3/2005 Kuo ..... A63B 22/0023 482/51
6,964,632 B1 * 11/2005 Ko ..... A63B 22/0023 482/54
7,704,191 B2 * 4/2010 Smith ..... A63B 22/0056 482/51
8,734,303 B2 * 5/2014 Huang ..... A63B 22/02 482/54
9,095,740 B2 * 8/2015 Wu ..... A63B 22/0023
2002/0147078 A1 * 10/2002 Wu ..... A63B 22/0023 482/54
2003/0125165 A1 * 7/2003 Trevino ..... A63B 22/0023 482/54
2003/0224910 A1 12/2003 Chang
2004/0132584 A1 * 7/2004 Chen ..... A63B 22/0023 482/54
2004/0214693 A1 * 10/2004 Piaget ..... A63B 22/025 482/52
2005/0159273 A1 * 7/2005 Chen ..... A63B 22/02 482/54
2005/0239607 A1 * 10/2005 Chang ..... A63B 22/0023 482/54
2006/0003869 A1 * 1/2006 Huang ..... A63B 22/02 482/54
2008/0188358 A1 * 8/2008 Kuo ..... A63B 22/0235 482/54
2011/0082011 A1 * 4/2011 Ellis ..... A63B 21/0615 482/54
2011/0312472 A1 * 12/2011 Piaget ..... A63B 22/025 482/52
2013/0123073 A1 * 5/2013 Olson ..... A63B 22/02 482/54
2013/0190136 A1 * 7/2013 Watterson ..... A63B 71/0622 482/8

FOREIGN PATENT DOCUMENTS

TW M439493 U1 10/2012
TW M505320 U 7/2015

* cited by examiner

TREADMILL

CROSS-REFERENCE TO RELATED APPLICATIONS

The entire contents of Taiwan Patent Application No. 104107265, filed on Mar. 6, 2015, from which this application claims priority, are expressly incorporated herein by reference.

BACKGROUND OF THE INVENTION

1. Field of the Invention

The present invention relates to a training machine, and more particularly relates to treadmill with adjustable inclination.

2. Description of Related Art

Nowadays, people tend to lack adequate exercise due to busy lifestyles. To the extent running has become popular as a simple and effective means for squeezing physical activity into a tight schedule, it is not always practicable. When the weather is bad or during particular times (such as at night), running on a treadmill can be more convenient as compared to being outside.

Some conventional treadmills are designed to include a ramp mechanism so that the front portion of the treadmill can be lifted, and thus running on an ascent can be simulated. However, the user of the treadmill may also want to simulate running on a descent.

SUMMARY OF THE INVENTION

In one general aspect, the present invention relates to treadmills featuring that running on an ascent or on a descent can be both simulated.

In an embodiment of the present invention, a treadmill is provided with a base, a first frame, a second frame, and a driving assembly. The base allows a user to walk or run in place. The first frame and the second frame pivotally couple with a front portion and a rear portion of the base, respectively. The driving assembly moveably couples with the first frame and the second frame. The moving of the driving assembly between the first frame and the second frame will result in an elevation of the front portion or the rear portion.

DETAILED DESCRIPTION OF THE INVENTION

Reference will now be made in detail to those specific embodiments of the invention. Examples of these embodiments are illustrated in accompanying drawings. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components. Wherever possible, the same or similar reference numbers are used in drawings and the description to refer to the same or like parts.

Figure 1:
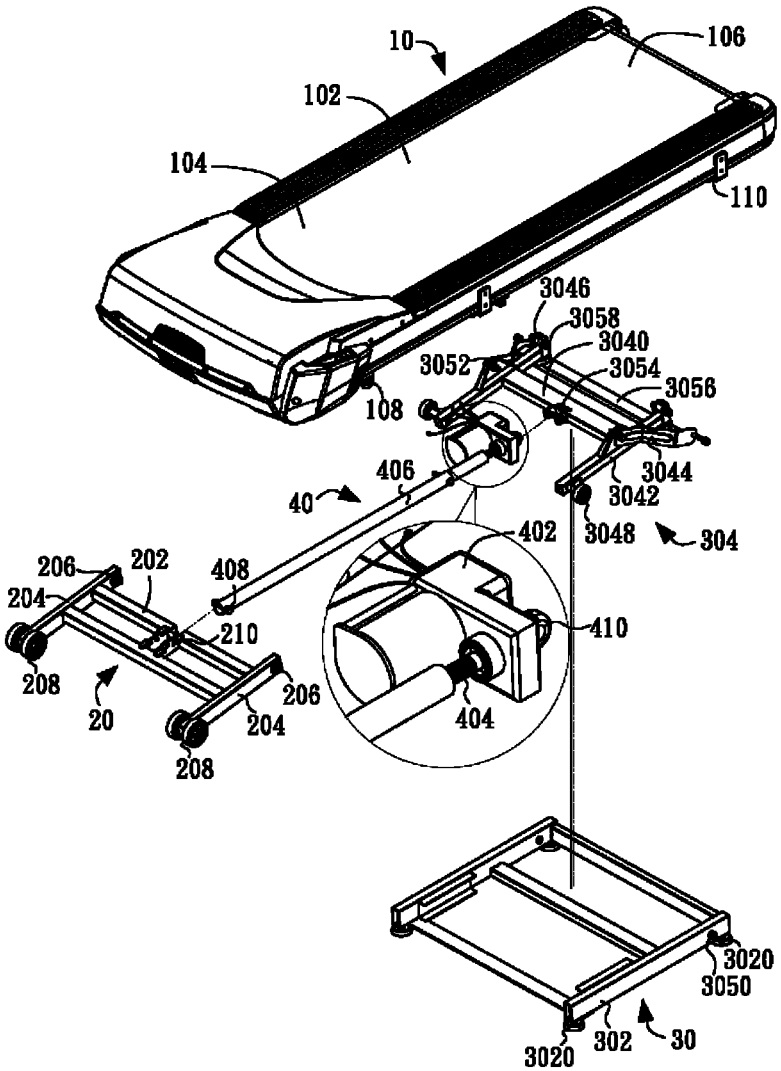
FIG. 1 is an exploded view showing a treadmill according to a preferred embodiment of the present invention.

FIG. 1 is an exploded view showing a treadmill 1 according to a preferred embodiment of the present invention. As shown in FIG. 1, the treadmill 1 comprises a base 10, a first frame 20, a second frame 30, and a driving assembly 40.

Figure 2A:
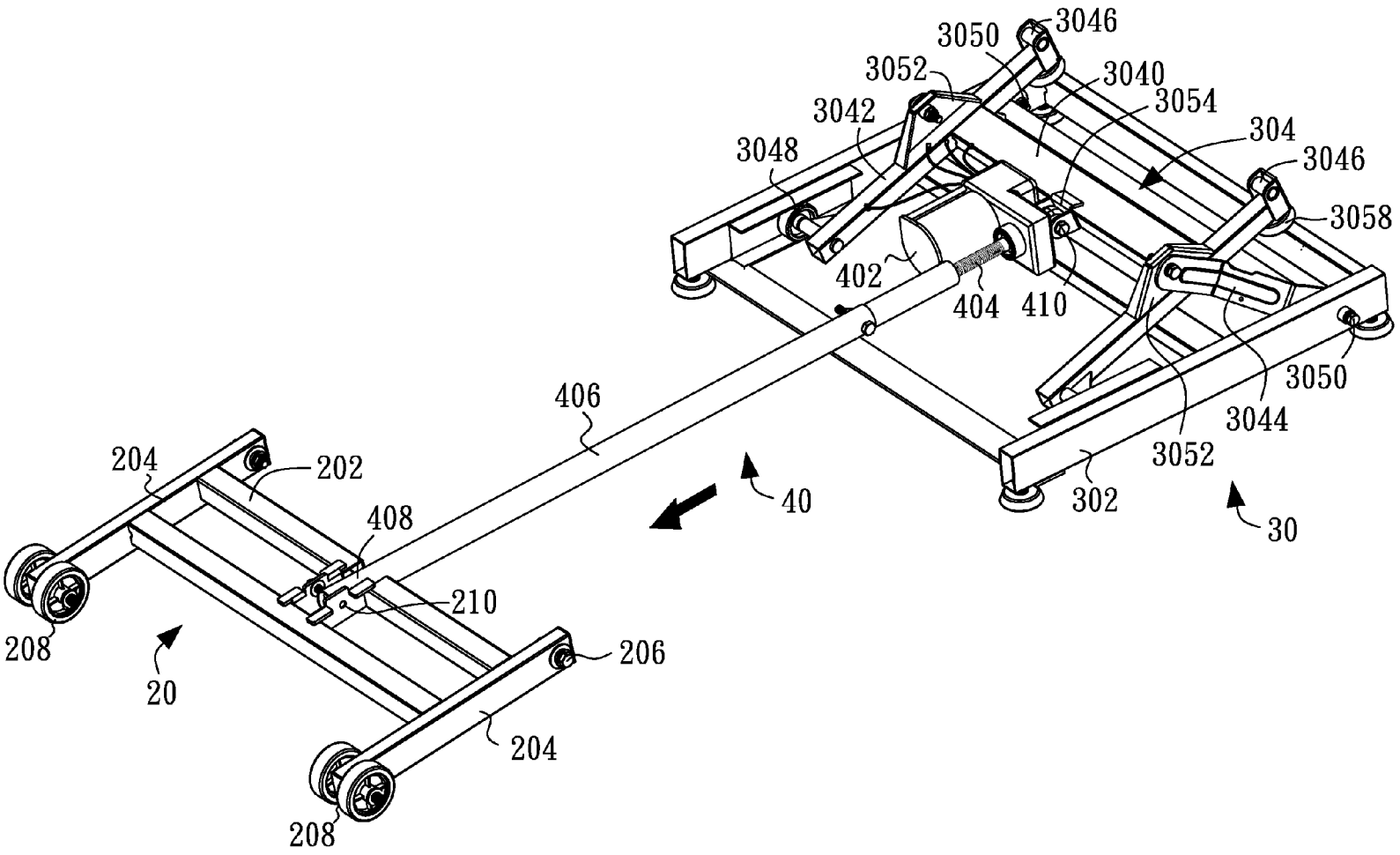
FIGS. 2A and 2B are perspective views showing a first frame, a second frame, and a driving assembly of FIG. 1.
Figure 2B:
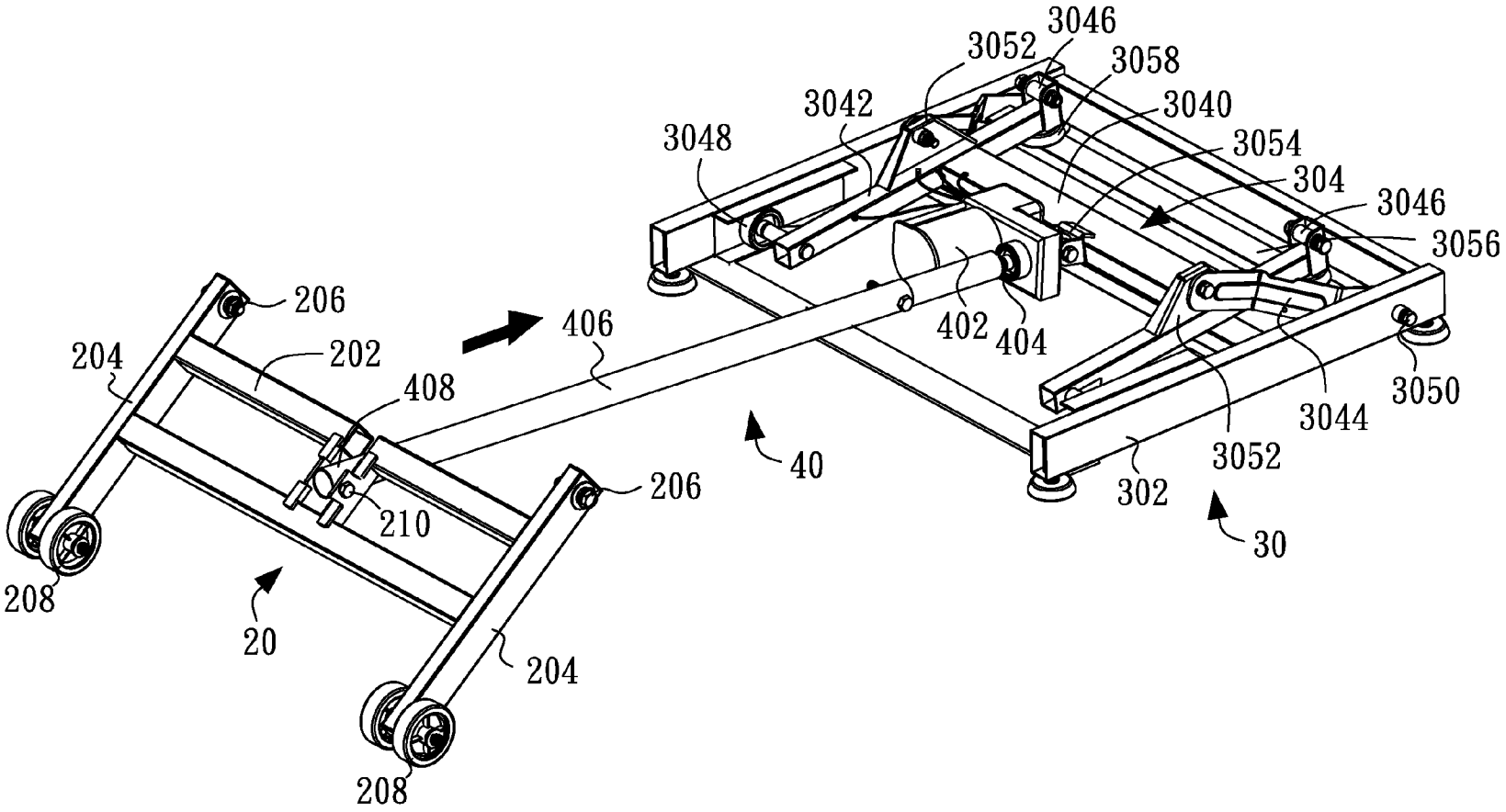

FIGS. 2A and 2B are perspective views showing the first frame 20, the second frame 30, and the driving assembly 40 of FIG. 1. Referring to FIGS. 1, 2A, and 2B, the base 10 may comprises a conveyor belt 102 allowing the user to run or walk on it. The first frame 20 is arranged under the base 10 and pivotally coupled with a front portion 104 of the base 10. The second frame 30 is arranged under the base 10 and pivotally coupled with a rear portion 106 of the base 10. The driving assembly 40 is arranged between the first frame 20 and the second frame 30, and movably couples with the first frame 20 and the second frame 30. The movement of the driving assembly 40 will result in an elevation of the first frame 20 or the second frame 30.

Notice is made that the components of the driving assembly 40 are movable between the first frame 20 and the second frame 30. The following will discuss the detail.

Figure 3:
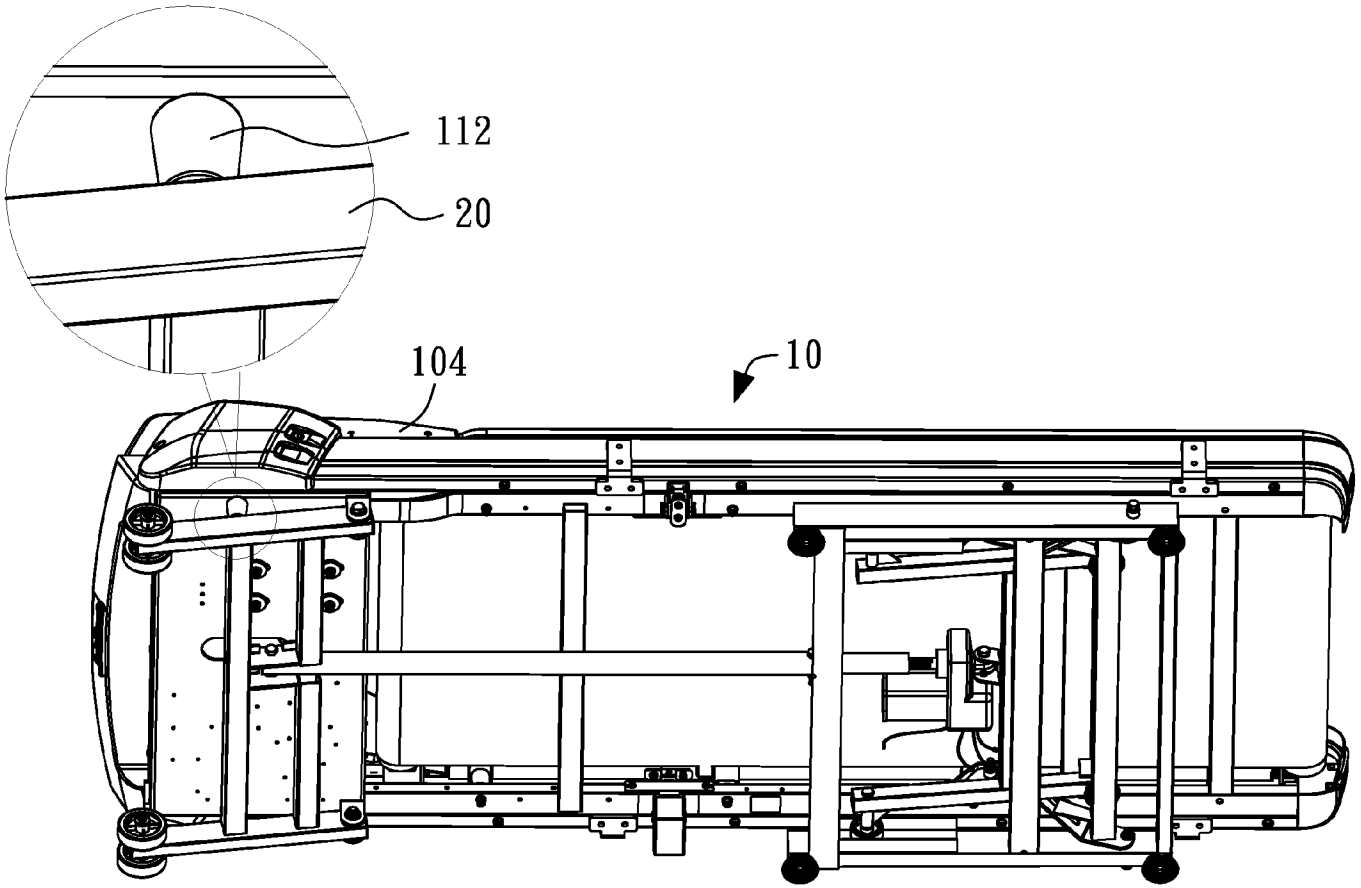
FIG. 3 is a perspective view and a partially enlarged view showing that a stop block is against the first frame when the treadmill of FIG. 1 is horizontal.

FIG. 3 is a perspective view showing that the base 10 of the treadmill 1 of FIG. 1 is at a horizontal condition. Referring to FIGS. 1, 2A, 2B, and 3, the first frame 20 may comprise, but is not limited to, a lateral stick 202 and two side sticks 204 arranged at a side of the lateral stick 202, respectively. Each side stick 204 includes two ends, in which one end has a wheel 208 against a supporting plane or ground, and the other end has a pivot portion 206 to pivotally couple with a pivot portion 108 of the front portion 104 of the base 10. As shown in FIG. 3, when the base 10 is horizontal, a stop block 112 under the front portion 104 of the base 10 is against the first frame 20.

Figure 4:
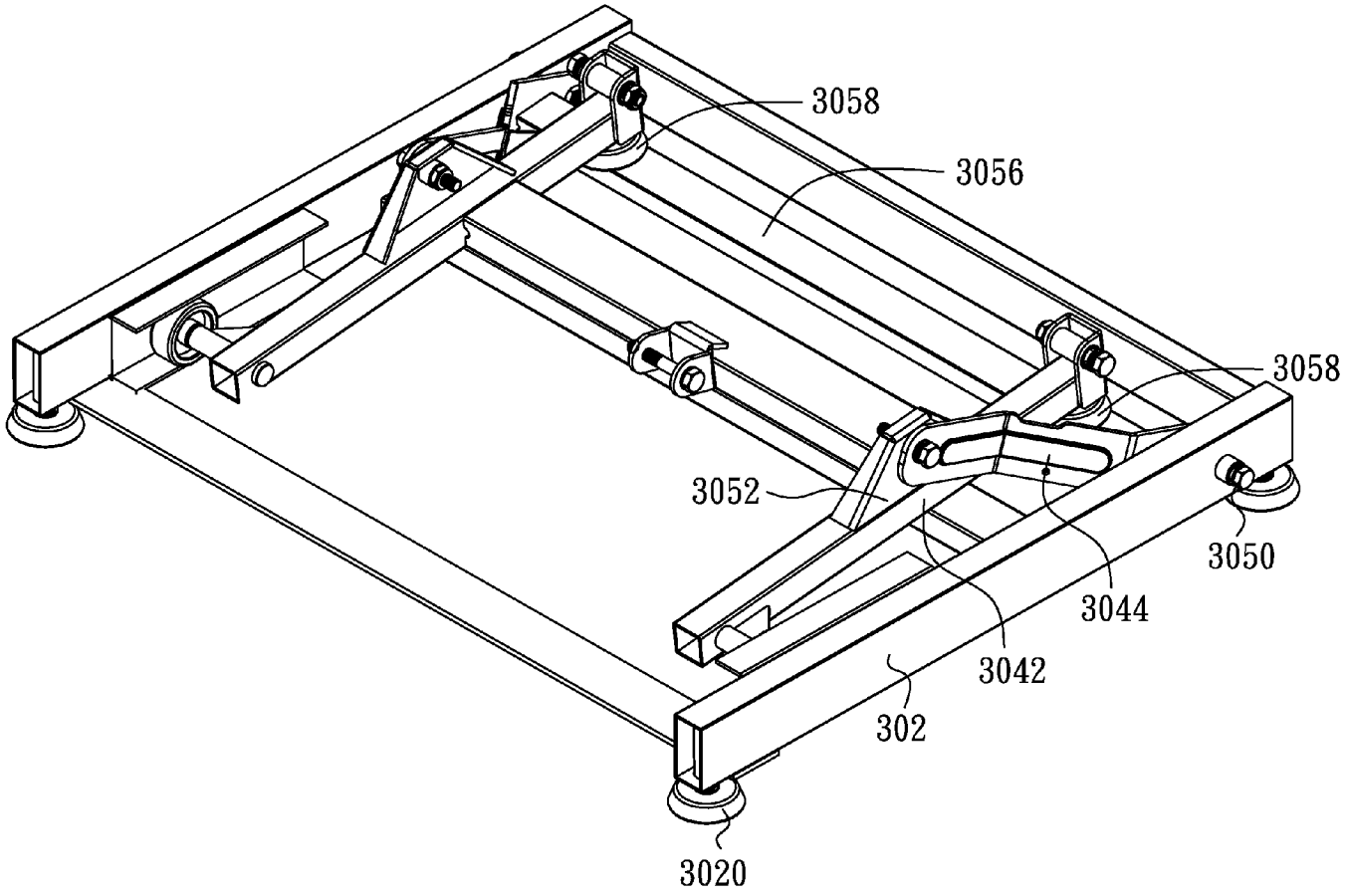
FIG. 4 is partially enlarged view showing that the second frame has pads against a lateral rod when the treadmill of FIG. 1 is horizontal.

FIG. 4 is a partially enlarged view showing the second frame of the treadmill 1 when the base 10 is horizontal. Referring to FIGS. 1, 2A, 2B, and 4, the second frame 30 may comprise, but is not limited to, an outer frame 302 and an inner frame 304. The outer frame 302 comprises four pads 3020 being placed against the supporting plane or ground. The inner frame 304 is arranged within the outer frame 302 and may comprise, but is not limited to, a lateral bar 3040, two longitudinal bars 3042, two rising arms 3044, and a lateral rod 3056. The two longitudinal bars 3042 are respectively arranged at a side of the lateral bar 3040. Each longitudinal bar 3042 comprises two ends, in which one end has a pivot portion 3046 to pivotally couple with a pivot portion 110 of the rear portion 106 of the base 10, and the other end has a wheel 3048 movably coupling with the outer frame 302. The two rising arms 3044 are respectively arranged at a side of the lateral rod 3056 and fixes with the lateral rod 3056. Each rising arm 3044 comprises two ends, in which one end pivotally couples to the outer frame 302 via an axis 3050, and the other end pivotally a pivot portion 3052 of a corresponded longitudinal bar 3042. In addition, the rear end of each longitudinal bar 3042 has a pad 3058, and when the base 10 is horizontal, the pad 3058 is against the lateral rod 3056.

Referring to FIGS. 1, 2A, and 2B, the driving assembly 40 may comprise, but is not limited to, a motor 402, a screw 404, and a tube 406. The tube 406 has internal thread to engage with the screw 404. Further, the tube 406 has a pivot portion 408 to pivotally couple with a pivot portion 210 of the first frame, and the motor 402 has a pivot portion 410 to pivotally couple with a pivot portion 3054 of the second frame 30. The motor 402 can drive the screw 404 to rotate, so that the tube 406 can move along the screw 404 in a direction toward the front portion 104 or the rear portion 106 of the base 10.

Figure 5:
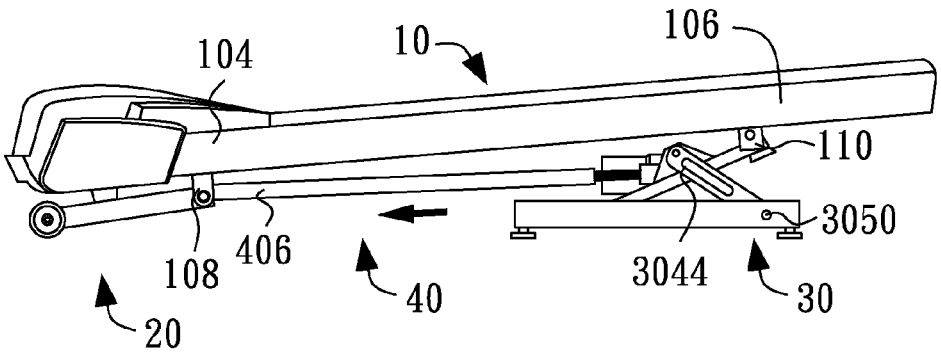
FIG. 5 is a side view showing that a rear portion of the treadmill of FIG. 1 is lifted.
Figure 6:
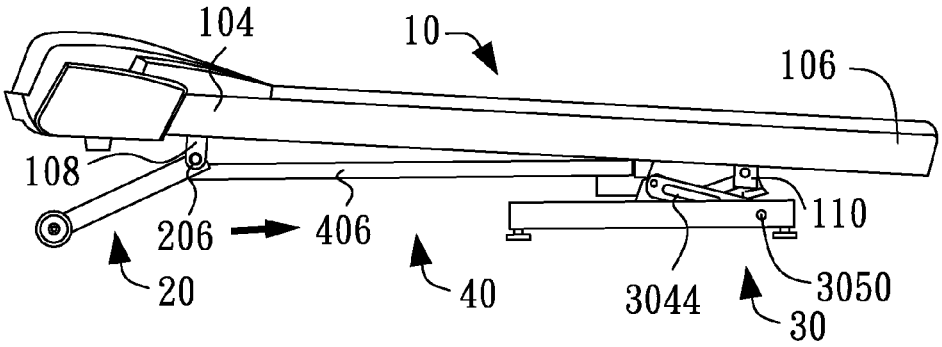
FIG. 6 is a side view showing that a front portion of the treadmill of FIG. 1 is lifted.

FIGS. 5 and 6 are side views showing the operation of the treadmill 1 of FIG. 1. As shown in FIG. 3, when the base is horizontal, the stop block 112 under the base 10 is against the first frame 20. Referring to FIGS. 2A, 3, and 5, when the user instructs to simulate running on a descent, the driving assembly 40 is controlled to move the tube 406 toward the front portion 104 and thus increase the total length of the driving assembly 40. At this time the stop block 112 blocks the first frame 20 to rise, and exerts a counterforce to the second frame 30 via the tube 406, so that the second frame 30 is lifted. In particular, the rising arm 3044 is raised by rotating around the axis 3050, and the wheel 3048 of the longitudinal bar 3042 moves toward the rear portion 106, so that the second frame 30 is lifted, and the whole driving assembly 40 is raised a bit as well. When the driving assembly 40 is controlled to move the tube 406 back to the original position, the base 10 will resume horizontal.

Referring to FIG. 4, when the base 10 is horizontal, the pads 3058 of the longitudinal bars 3042 are against the lateral rod 3056. Referring to 2B and 6, when the user instructs to simulate running on an ascent, the driving assembly 40 is controlled to move the tube 406 toward the rear portion 106 and thus decrease the total length of the driving assembly 40. At this moment the second frame 30 cannot be lowered because the pads 3058 are against the lateral rod 3056, such that the tube 406 will drag the first frame 20 moving toward the rear portion 106 and thus make the first frame 20 lifted, and the whole driving assembly 40 is raised a bit as well. When the driving assembly 40 is controlled to move the tube 406 back to its original position, the base 10 will resume horizontal.

Preferably, the stop block 112 and the pads 3058 are made of a material or a composite material whose at least a portion is soft or elastic, so as to reduce noise due to contact with the lateral rod 3056 and the first frame 20 that are typically made of metal.

Accordingly, the above embodiment of the present invention provides a treadmill, which employs merely one driving assembly to achieve the elevation of the front portion or the rear portion of the base. The configuration is simple and low-lost, while the response is effective and fast.

Figure 7:
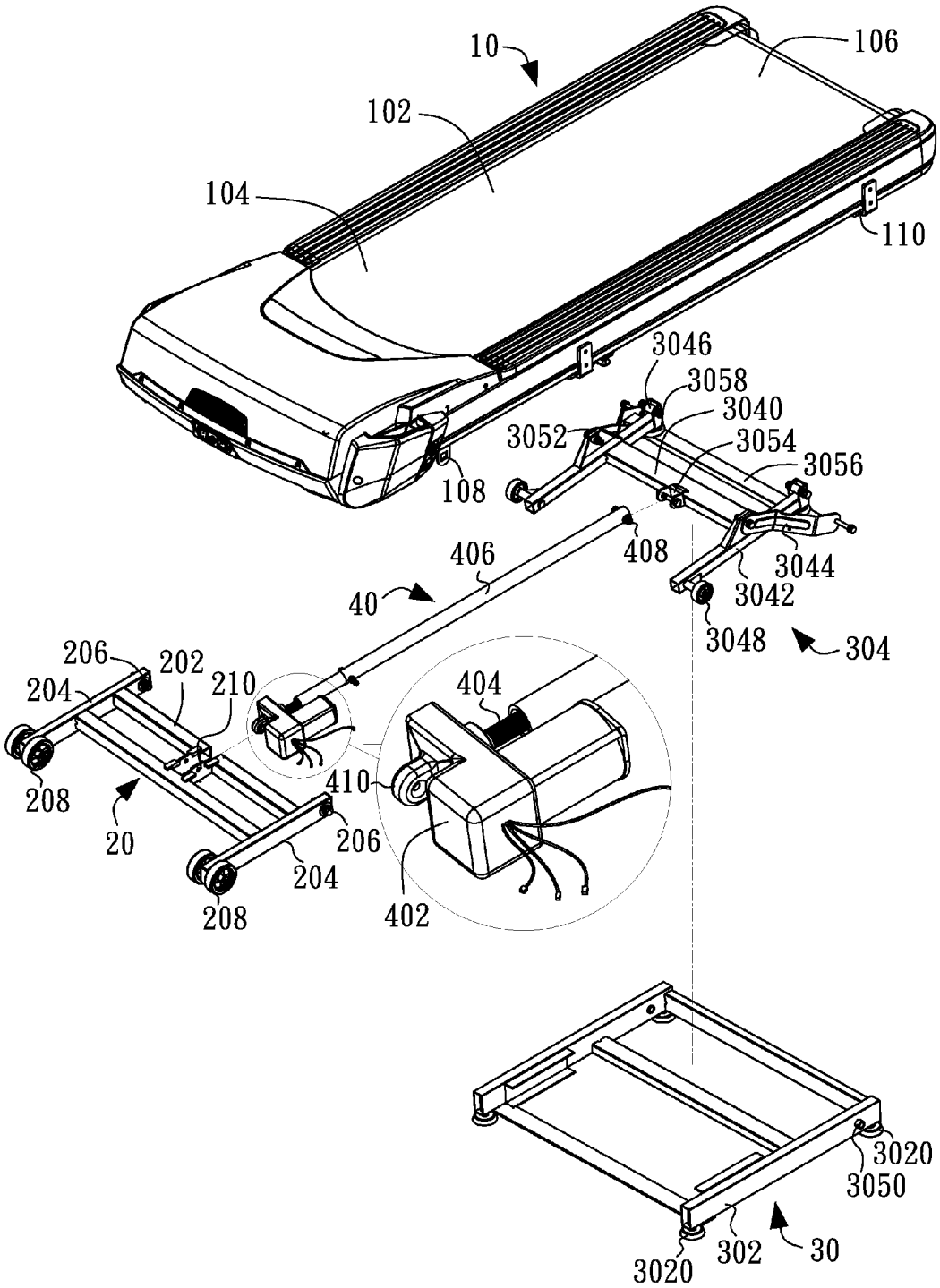
FIG. 7 is an exploded view showing another treadmill according to another embodiment of the present invention.

Modifications, variations, and equivalents may be made for the above-mentioned embodiment for a person skilled in the art, and those modifications, variations, and equivalents are within the scope of the present invention. FIG. 7 is an exploded view showing a treadmill according to another embodiment of the present invention. In this embodiment, the pivot portion 408 of the tube 406 pivotally couples with the pivot portion 3054 of the second frame 30, and the pivot portion 410 of the motor 402 pivotally couples with the pivot portion 210 of the first frame 20. The motor 402 drives the screw 404 to rotate, so that the tube 406 moves along the screw 404 in a direction toward the front portion 104 or the rear portion 106. When the base 10 is horizontal and the motor 402 drives to the tube 406 moving toward the front portion 104, the first frame 20 will be lifted. When the base 10 is horizontal and the motor 402 drives to the tube 406 moving toward the rear portion 106, the rear frame 30 will be lifted. The other features of this embodiment may be the same as the foregoing embodiment.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. A treadmill, comprising:

a base allowing a user to run or walk;

a first frame arranged under the base and pivotally coupled with a front portion of the base, comprising:

a lateral stick; and two side sticks being respectively arranged at a left and a right side of the lateral stick and being coupled with the lateral stick, each side stick comprising two ends, in which one end includes a first wheel against a ground and the other end pivotally couples with a pivot portion of the front portion of the base;

a second frame arranged under the base and pivotally coupled with a rear portion of the base, comprising:

an outer frame to contact with the ground;

an inner frame being arranged within the outer frame and being pivotally coupled with the outer frame, the inner frame comprising:

a lateral bar; and two longitudinal bars being respectively arranged at a left side and right side of the lateral bar and being coupled with the lateral bar, each longitudinal bar comprising two ends, in which one end pivotally couples with the rear portion of the base, and the other end comprises a second wheel to movably couple with the outer frame; and a driving assembly movably coupled with the lateral stick of the first frame and the inner frame of the second frame;

wherein the driving assembly comprises a tube moveably coupled with the lateral stick of the first frame and the lateral bar of the inner frame, and when the tube moves toward the lateral stick of the first frame, the second frame is lifted so that a height of a rear portion of the base is greater than a height of a front portion of the base; and when the tube moves toward the lateral bar of the inner frame, the first frame is lifted so that the height of the front portion of the base is greater than the height of the rear portion of the base.

2. The treadmill as set forth in claim 1, wherein the driving assembly further comprises a motor and a screw.

3. The treadmill as set forth in claim 2, wherein the tube comprises internal thread to engage the screw, the tube pivotally couples with the lateral stick of the first frame, the motor pivotally couples with the second frame, and the motor drives the tube moving along the screw in a direction toward the front portion or the rear portion of the base.

4. The treadmill as set forth in claim 1, wherein the base further comprises a stop block arranged under the front portion of the base, and when the base is horizontal, the stop block is against the first frame.

5. The treadmill as set forth in claim 1, wherein the inner frame further comprises:

a lateral rod;

two rising arms respectively arranged at a side of the lateral rod, wherein each rising arm comprises two ends, in which one end pivotally couples with the outer frame, and the other end couples with a pivot portion of one corresponded longitudinal bar of the two longitudinal bars.

6. The treadmill as set forth in claim 5, wherein each longitudinal bar further comprises a pad under the end coupled with the rear portion of the base, and when the base is horizontal, the pad is against the lateral rod.

* * * * *